US009240657B2

(12) United States Patent
Chang et al.

(10) Patent No.: US 9,240,657 B2
(45) Date of Patent: Jan. 19, 2016

(54) SOCKET CONNECTOR WITH SHIELDING STRUCTURE

(71) Applicant: HON HAI PRECISION INDUSTRY CO., LTD., New Taipei (TW)

(72) Inventors: Yen-Chih Chang, New Taipei (TW); Tzu-Yao Hwang, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 15 days.

(21) Appl. No.: 14/323,252

(22) Filed: Jul. 3, 2014

(65) Prior Publication Data

US 2015/0011122 A1 Jan. 8, 2015

(30) Foreign Application Priority Data

Jul. 3, 2013 (TW) ..... 102212480 A

(51) Int. Cl.
*H01R 12/00* (2006.01)
*H01R 13/6588* (2011.01)
*H01R 13/24* (2006.01)

(52) U.S. Cl.
CPC ..... *H01R 13/6588* (2013.01); *H01R 13/2442* (2013.01)

(58) Field of Classification Search
CPC .... H01R 23/722; H01R 23/725; H01R 9/096; H01R 13/2435; H01R 13/2414; H05K 7/1069
USPC ..... 439/66, 71, 74, 607.08
See application file for complete search history.

(56) References Cited

U.S. PATENT DOCUMENTS

| | | | | |
|---|---|---|---|---|
| 7,322,830 | B2 * | 1/2008 | Szu | H01R 13/2442 439/330 |
| 7,497,733 | B1 * | 3/2009 | Van der Steen | H01R 23/6873 439/607.01 |
| 8,851,904 | B2 * | 10/2014 | Chang | H01R 12/71 439/607.03 |
| 2013/0237091 | A1 * | 9/2013 | Mason | H01R 13/6585 439/607.05 |

* cited by examiner

*Primary Examiner* — Hien Vu
(74) *Attorney, Agent, or Firm* — Wei Te Chung; Ming Chieh Chang

(57) ABSTRACT

A socket connector includes an insulative base (2), a plurality of contacts (3) therein with an engaging portion (32) and a floating cover (5). The floating cover (5) includes a plurality of through holes (53) for receiving the engaging portions (32) extending therethrough. The socket connector includes a metallic shell (4) having a plurality of receiving holes (41) for receiving the contacts therein and electrically engaging with a metallic surface (52) formed on bottom of the floating cover (5).

10 Claims, 5 Drawing Sheets

SOCKET CONNECTOR WITH SHIELDING STRUCTURE

BACKGROUND OF THE INVENTION

1. Field of the Invention

The present invention relates to a socket connector, and more particularly to a socket connector with shielding structure.

2. Description of the Related Art

A conventional socket connector attaching a CPU to a PCB has a corresponding structure to mate with the conductive pads of the CPU to shorten telecommunication transporting path for obtaining lower resistance. By this way, it can prevent signal disturbance in high speed transporting circumstance. Such a typical socket connector generally includes a base mounted on a PCB, and a plurality of contacts residing in the base. A pressing force is needed to make the CPU press the contacts for making the contacts be elastically deformed, which enables the contacting portions of the contacts to mate readily with conductive pads of the CPU.

U.S. Pat. No. 7,322,830 issued to Szu on Jan. 29, 2008, discloses such a typical socket connector. The socket connector includes a base mounted on a PCB, a cover for holding a CPU, and a plurality of contacts each of which has a supporting portion received in the base and an engaging portion reaching out of the base. The cover is formed with a number of through holes for fixing the contact. Every engaging portion crosses and partially extends out of the corresponding through hole. In process of assembly, each contact is pressed and generates elastic deformation, which causes its engaging portion to move and scrape a surface of the corresponding conductive pad due to the pressure from the CPU. Because the CPU and the cover can move with the engaging portions simultaneously, the engaging portions keep motionless relative to the corresponding conductive pads of the CPU.

However, the contacts are easily interference with each other because an absence of shielding to thereof for preventing from crosstalk.

Therefore, an improved socket connector are desired to overcome the disadvantages of the related arts.

SUMMARY OF THE INVENTION

An object of the present invention is to provide a socket connector with shielding structure for preventing from crosstalk.

In order to achieve the above-mentioned object, a socket connector in accordance with a preferred embodiment of the present invention includes an insulative base, a plurality of contacts therein with an engaging portions and a floating cover. The floating cover includes a plurality of through holes for receiving the engaging portions extending therethrough. The socket connector includes a metallic shell having a plurality of receiving holes for receiving the contacts therein and electrically engaging with a metallic surface formed on bottom of the floating cover for preventing from crosstalk.

Other objects, advantages and novel features of the invention will become more apparent from the following detailed description of the present embodiment when taken in conjunction with the accompanying drawings.

DETAILED DESCRIPTION OF THE INVENTION

Figure 1:
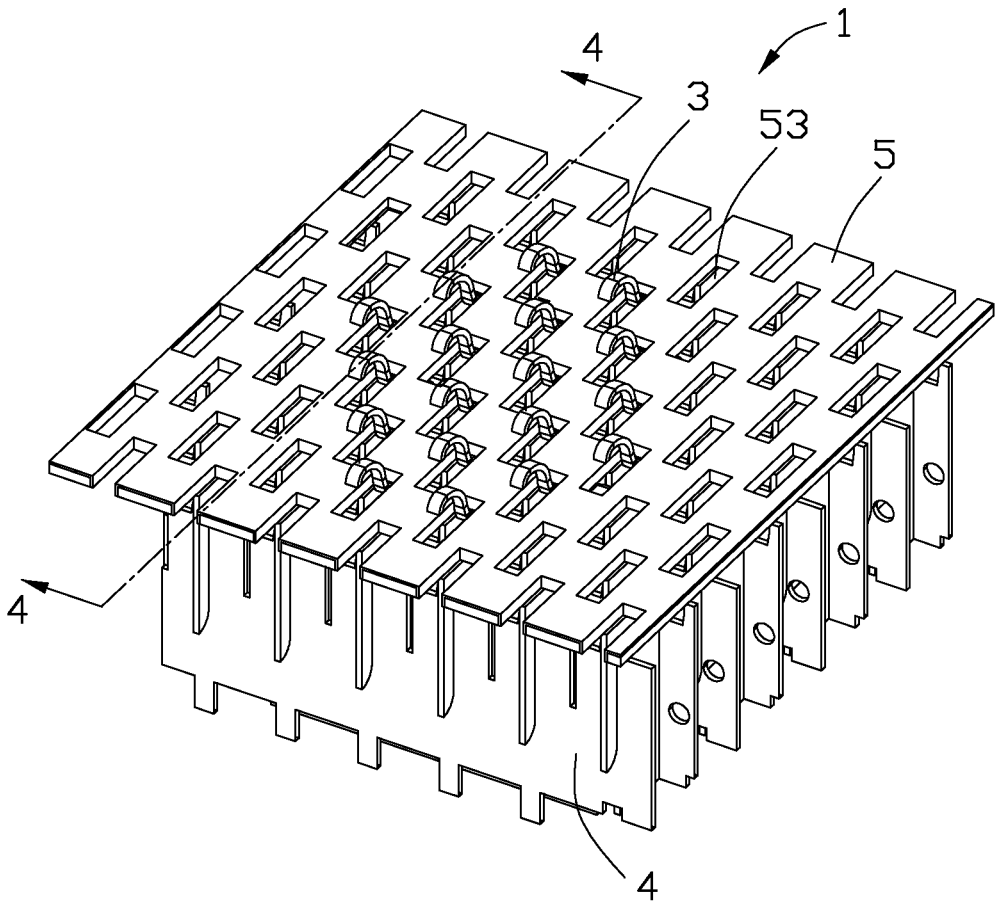
FIG. 1 is a perspective view of a socket connector in accordance with the preferred embodiment of the present invention.

Reference will now be made to the drawing figures to describe the preferred embodiments of the present invention in detail.

Figure 2:
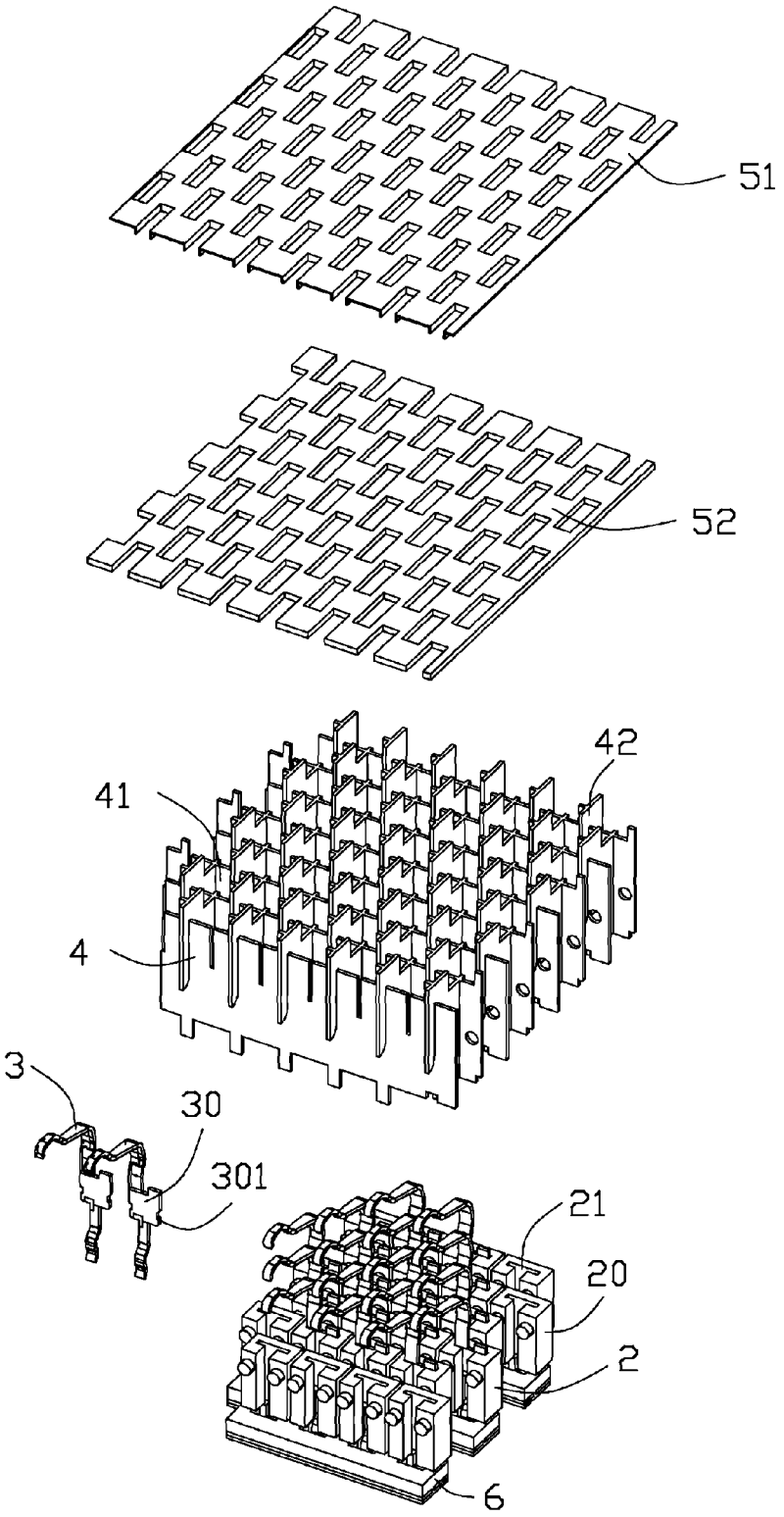
FIG. 2 is an exploded perspective view of the socket connector shown in FIG. 1.
Figure 3:
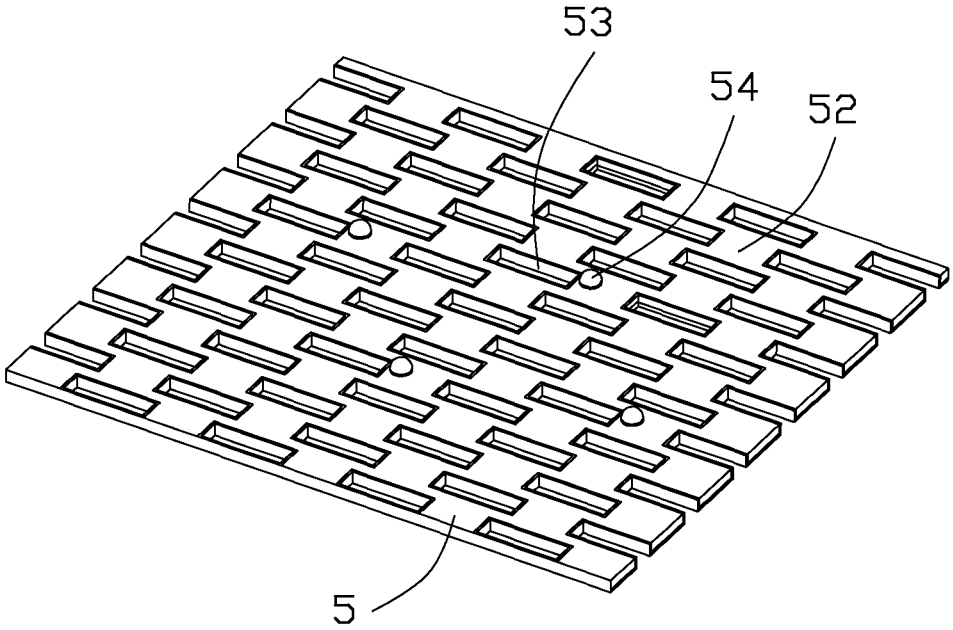
FIG. 3 is a bottom perspective view of a metallic shell of the socket connector shown in FIG. 2.

As illustrated in FIGS. 1 to 3, a socket connector 1 for attaching a CPU (not shown) to a PCB (not shown) includes an insulative base 2 mounted on the PCB, a plurality of contacts 3 residing in the insulative base 2, a metallic shell 4 retained in the insulative base 2, a floating horizontal cover 5 mounting on the insulative base 2 and moveable in a vertical direction for holding the CPU and a plurality of contacts 3 residing in the base 2 and a horizontal bottom cover plate 6 located below the metallic shell 4.

The insulative base 2 is divided to a plurality of base units 20 extending along a first direction and being hold by the metallic shell 4 together. The contact 3 are associated in the base units 20 thereby forming a plurality of terminal modules. The insulative base 2 is facing the cover 5 and defines a plurality of passageways 21 receiving the contacts 3. The metallic shell 4 is attached to the insulative base 2. The metallic shell 4 includes a plurality of receiving holes 41 for receiving the contacts 3 therein, i.e. the metallic shell 4 defining a grid like cross-sectional configuration in a top view, and a plurality of protruding portions 42 for supporting the floating cover 5 on the metallic shell 4.

Figure 4:
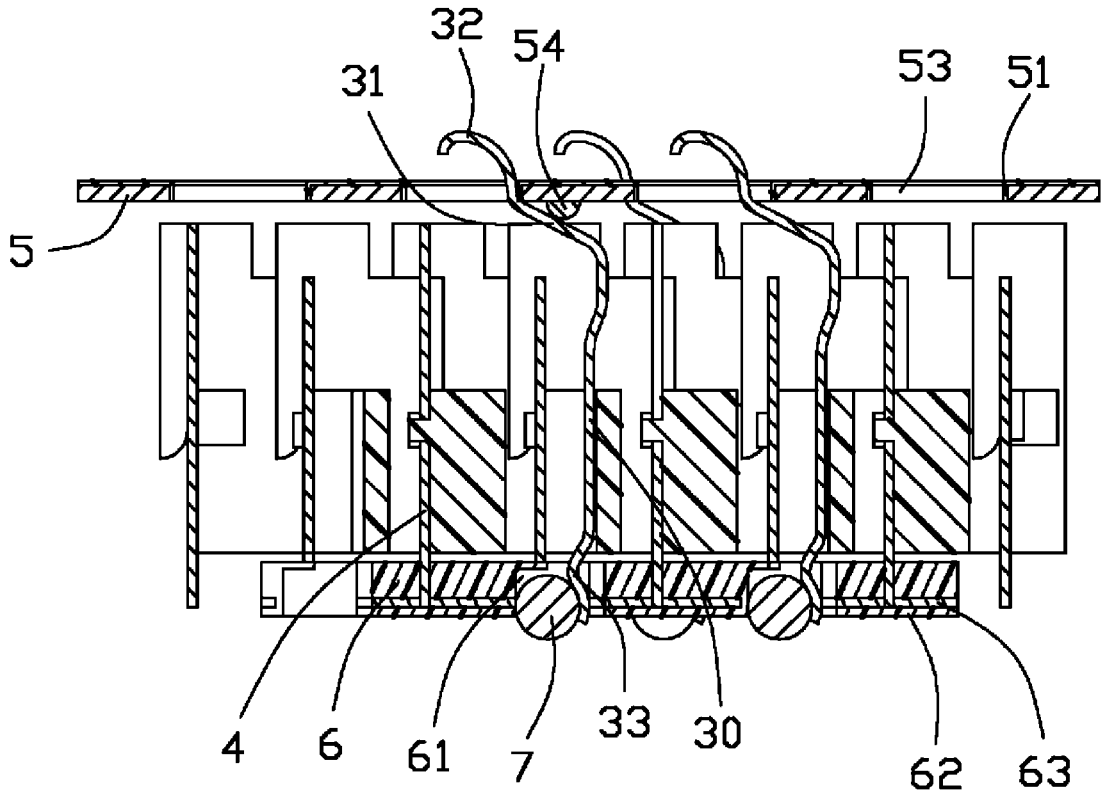
FIG. 4 is a cross-section view of the socket connector taken along line 4-4 of FIG. 1.
Figure 5:
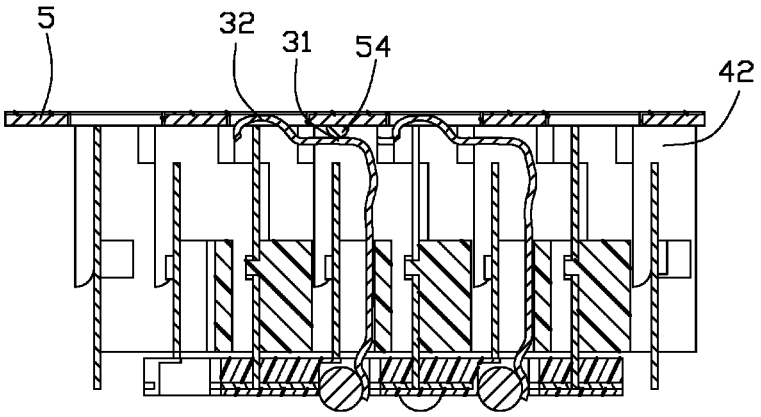
FIG. 5 is a cross-section view of the socket connector shown in FIG. 4 in which the shielding cover moved to another status.

Referring to FIG. 4 and FIG. 5, the contact 3 comprises a supporting portion 30 defining barbs 301 retained in the insulative base 2, a spring portion 31 extending upwards and bended from the supporting portion 30, an engaging portion 32 extending upwards from the extending portion 31 in a second direction, in said top view, angled with the first direction for contacting with the CPU and a soldering portion 33 which is planar and extends from the bottom of the supporting portion 30 for soldering to the PCB.

The floating horizontal cover 5 is movably mounted above the insulative base 2 and is supported by the protruding portion 42 of the metallic shell 4. The floating cover 5 is configuration of a rectangular shape like the insulative base 2 and comprises an upper insulative surface 51 and a metallic surface 52 located on bottom side of the insulative surface 51. The floating cover 5 forms a plurality of through holes 53 for receiving the engaging portions 32 of the contacts 3 extending therethrough to contacting with the CPU. The insulative surface 51 is provided by an insulative plate or an insulative coating layer which prevents the metallic surface 52 from shorting with the CPU and extends into the through holes 53. The metallic surface 52 is provided by a metallic plate or a metallic coating layer for electrically connecting with the metallic shell 4. The floating cover 5 defines a metallic grounding portion 54 being formed on bottom side of the metallic surface 52 and always engaging with at least one of the contact 3, thereby building a grounding path between the metallic surface 52 and the grounding contact 3 for preventing crosstalk. The metallic grounding portion 54 is formed by a solder ball adhering to the metallic surface 52.

In assembly of the CPU and the socket connector 1, the CPU and the cover 5 moves downwards while moves along an extending direction of the spring portion 31. The floating cover 5 is moved between a first position in which the cover 5 disengages with the metallic shell 4 and the contacts 3 protrudes out of the cover 5 and do not pressed downwardly by the CPU and a second position in which the CPU presses downwardly the contact 3 and the spring portion 31 of the contact 3 deforms so that the engaging portion 32 moves approximately along a track of curve, until the cover 5 engages with the protruding portion 42 of the metallic shell 4 for providing another grounding path and preventing from crosstalk.

The horizontal bottom cover plate 6 defines a plurality of recesses 61 to receive corresponding solder balls 7 which are soldered to the lower soldering portion 33 of the corresponding contacts 3, respectively, and said horizontal bottom cover plate 6 includes an insular plate 62 and an embedded metallic shield layer 63 mechanically and electrically connecting the metallic shell 4, thereby the metallic shell 4 electrically connects with the upper cover 5 and bottom cover plate 6 for grounding.

It is to be understood, however, that even though numerous characteristics and advantages of the present invention have been set forth in the foregoing description, together with details of the structure and function of the invention, the dislosure is illustrative only, and changes may be made in detail, especially in matters of shape, size, and arrangement of parts within the principles of the invention to the full extent indicated by the board general meaning of the terms in which the appended claims are expressed.

What is claimed is:

1. A socket connector comprising:

an insulative base comprising a plurality of passageways receiving a plurality of contacts therein and the contacts having engaging portions at end portions thereof;

a floating cover movably mounted above the insulative base and comprising a plurality of through holes for receiving the engaging portions of the contacts extending therethrough; and wherein the socket connector comprises a metallic shell retained in the insulative base, the metallic shell comprises a plurality of receiving holes to receive the contacts therein and electrically engages with a metallic layer formed on bottom of the floating cover;

wherein the metallic shell comprises a plurality of protruding portions engaging with the metallic layer.

wherein the floating cover comprises an upper insulative layer which prevents the metallic layer from short circuit and the upper insulative layer extends into the through holes; and wherein the floating cover comprises a metallic grounding portion being formed on bottom side of the metallic layer and always engaging with at least one of the contacts, thereby building another grounding path between the metallic layer and the at least one of the contacts for preventing crosstalk.

2. The socket connector as described in claim 1, wherein the metallic grounding portion is formed by a solder ball adhering to the metallic surface.

3. The socket connector as described in claim 1, wherein the floating cover is moved between a first position in which the cover disengages with the metallic shell and the contacts protrudes out of the cover and a second position in which the contact are pressed downwardly and deformed so that the engaging portion moves approximately along a track of curve, until the cover engages with the metallic shell.

4. A socket connector comprising:

an insulative base comprising a plurality of passageways receiving a plurality of contacts therein and the contacts having engaging portions at end portions thereof for electrically connecting with a CPU; and a cover movably mounted above the insulative base and comprising a plurality of through holes for receiving the engaging portions of the contacts extending therethrough;

wherein the cover comprises an upper insulative surface and a metallic surface located on bottom side of the insulative surface and electrically engaging with the selected contacts;

wherein said cover is moving up and down floatable.

wherein the cover comprises a metallic grounding portion being formed on bottom side of the metallic surface and always engaging with at least one of the contacts, thereby building a grounding path between the metallic surface and the least one grounding contact for preventing crosstalk, wherein the insulative surface is provided by an insulative plate or an insulative coating layer, wherein the metallic surface is provided by a metallic plate or a metallic coating layer for electrically connecting with a metallic shell retained in the insulative base.

5. The socket connector as described in claim 4, wherein the metallic grounding portion is formed by a solder ball adhering to the metallic surface.

6. The socket connector as described in claim 4, wherein the upper insulative surface prevents the metallic surface from short circuit and extends into the through holes.

7. A socket connector for use with an electronic package, comprising:

a metallic shield structure defining a grid like cross-sectional configuration in a top view;

a terminal module assembly secured to the shield structure and including a plurality of contacts associated therewith, each of said contacts including an upper mating section and a lower mounting section in a vertical direction, said contacts being categorized with grounding contacts and signal contacts;

a horizontal upper cover plate mounted above the shield structure and defining a plurality of through holes through which the upper mating sections of the contacts extend upwardly;

wherein the upper cover plate includes an insulative structure on an upper side thereof for not improperly electrically connecting to the electronic package which is adapted to be mounted upon the cover plate, and a metallic structure on a bottom side thereof for mechanically and electrically connecting the shield structure;

wherein said metallic structure further mechanically and electrically connects to the corresponding grounding contacts;

wherein said cover plate is moveable in said vertical direction;

the socket connector further including a horizontal bottom cover plate located below the shield structure, wherein said horizontal bottom cover plate defines a plurality of recesses to receive corresponding solder balls which are soldered to the lower mounting sections of the corresponding contacts, respectively, and said horizontal bottom cover plate includes an embedded metallic shield layer mechanically and electrically connecting the shield structure.

8. The socket connector as claimed in claim 7, wherein said terminal module assembly includes a plurality of terminal modules each defining an insulator extending along a first direction, in said top view, with the associated contacts therein.

9. The socket connector as claimed in claim 8, wherein the upper mating section extends in a second direction, in said top view, angled with said first direction.

10. The socket connector as claimed in claim 7, wherein each of said through hole is coated with insulative material on interior surfaces.

* * * * *